US010253791B2

(12) United States Patent
Kudo et al.

(10) Patent No.: US 10,253,791 B2
(45) Date of Patent: Apr. 9, 2019

(54) FLUID PRESSURE CYLINDER WITH BOOSTING MECHANISM

(71) Applicant: SMC CORPORATION, Chiyoda-ku (JP)

(72) Inventors: Masayuki Kudo, Joso (JP); Yuichi Tanabe, Nagareyama (JP); Eiko Miyasato, Moriya (JP)

(73) Assignee: SMC CORPORATION, Chiyoda-ku (JP)

( * ) Notice: Subject to any disclaimer, the term of this patent is extended or adjusted under 35 U.S.C. 154(b) by 74 days.

(21) Appl. No.: 15/651,447

(22) Filed: Jul. 17, 2017

(65) Prior Publication Data

US 2018/0031011 A1 Feb. 1, 2018

(30) Foreign Application Priority Data

Jul. 26, 2016 (JP) ..... 2016-146665

(51) Int. Cl.

| | |
|---|---|
| ***F15B 11/02*** | (2006.01) |
| ***F15B 15/22*** | (2006.01) |
| ***F15B 15/14*** | (2006.01) |
| *F15B 11/036* | (2006.01) |

(52) U.S. Cl.

CPC ..... *F15B 15/221* (2013.01); *F15B 15/1409* (2013.01); *F15B 15/149* (2013.01); *F15B 15/1447* (2013.01); *F15B 15/1457* (2013.01); *F15B 11/022* (2013.01); *F15B 11/0365* (2013.01); *F15B 2211/775* (2013.01)

(58) Field of Classification Search

CPC ..... F15B 11/022; F15B 2211/775; F15B 15/1447; F15B 15/221

USPC ..... 91/359

See application file for complete search history.

(56) References Cited

U.S. PATENT DOCUMENTS 5,361,680 A * 11/1994 Matsui ..... F15B 11/0365 91/419

FOREIGN PATENT DOCUMENTS

| | | |
|---|---|---|
| JP | 6-42507 | 2/1994 |
| JP | 6-300008 | 10/1994 |
| JP | 11-166506 | 6/1999 |

* cited by examiner

*Primary Examiner* — F Daniel Lopez
*Assistant Examiner* — Daniel S Collins
(74) *Attorney, Agent, or Firm* — Oblon, McClelland, Maier & Neustadt, L.L.P.

(57) ABSTRACT

A communication path that communicates with a first main pressure chamber is provided in a main piston and a piston rod. A check valve, which opens by being pressed by a booster piston and allows the communication path to communicate with a first sub-pressure chamber when the piston rod reaches a booster start position before a forward stroke end, is disposed in an end portion of the communication path. A plurality of steel balls are disposed in a coupling-member containing chamber formed in the booster piston. An engagement surface and an engagement groove, which engage with the steel balls when the booster piston moves forward due to an action of a pressure fluid supplied to the first sub-pressure chamber 11*a* through the communication path, are formed in the coupling-member containing chamber and an outer peripheral surface of the piston rod.

8 Claims, 9 Drawing Sheets

FLUID PRESSURE CYLINDER WITH BOOSTING MECHANISM

TECHNICAL FIELD

The present invention relates to a fluid pressure cylinder with a booster mechanism that increases thrust in the second half of a forward stroke of a piston rod by using the booster mechanism.

BACKGROUND ART

In working machines, such as a clamping device, a compressing device, or a spot welding device, typically, a considerably large driving force is not necessary in the first half of a working process and a large driving force is necessary in the second half of the working process. Therefore, as disclosed in Patent Literatures (PTLs) 1 to 3, fluid pressure cylinders used in such working machines increase thrust in the second half of a working stroke (forward stroke) of a piston rod by additionally including booster mechanisms having various structures.

The fluid pressure cylinder with a booster mechanism disclosed in each of PTLs 1 to 3 includes a booster piston in addition to a main piston for driving the piston rod. When the piston rod reaches a booster start position before a forward stroke end, a pressure fluid is supplied to the booster piston to move the booster piston forward so that thrust of the booster piston acts on the piston rod. Thus, the piston rod is moved forward by large combined thrust that is the sum of the thrust of the main piston and the thrust of the booster piston. Therefore, in the fluid pressure cylinder with a booster mechanism, in addition to a port for causing the pressure fluid to act on the main piston, a port for causing the pressure fluid to act on the booster piston is necessary. Accordingly, the number of pipes becomes larger than that of an ordinary fluid pressure cylinder.

On the other hand, for a working machine including such a fluid pressure cylinder with a booster mechanism, it is required that the number of pipes be reduced as much as possible in order to increase safety by preventing damage to pipes around the fluid pressure cylinder due to contact with peripheral equipment and in order to simplify the operation of connecting pipes and the maintenance and management of pipes.

CITATION LIST

Patent Literature

[PTL 1] Japanese Unexamined Patent Application Publication No. 6-42507

[PTL 2] Japanese Unexamined Patent Application Publication No. 6-300008

[PTL 3] Japanese Unexamined Patent Application Publication No. 11-166506

SUMMARY OF INVENTION

Technical Problem

A technical object of the present invention is to provide a fluid pressure cylinder with a booster mechanism in which the number of ports is made smaller than that of an existing fluid pressure cylinder with a booster mechanism by efficiently disposing a channel for supplying a pressure fluid to a booster piston and thereby the number of pipes is reduced to improve safety and to simplify piping work.

Solution to Problem

In order to achieve the object, a fluid pressure cylinder with a booster mechanism according to the present invention is structured as follows. A main cylinder chamber and a booster cylinder chamber that are separated by a partition wall are provided in a cylinder body. A main piston is disposed in the main cylinder chamber so as to be slidable in a direction along an axial line, and the main cylinder chamber is divided by the main piston into a first main pressure chamber and a second main pressure chamber. A booster piston is disposed in the booster cylinder chamber so as to be slidable in the direction along the axial line, and the booster cylinder chamber is divided by the booster piston into a first sub-pressure chamber and a second sub-pressure chamber. A first port that communicates with the first main pressure chamber and a second port that communicates with the second main pressure chamber and the second sub-pressure chamber are provided in the cylinder body. A piston rod is coupled to the main piston, and the piston rod extends to an outside through the partition wall, the booster piston, and an end wall of the booster cylinder chamber. A communication path, one end of which communicates with the first main pressure chamber and at the other end of which a check valve is disposed, is provided in the main piston and the piston rod, and the check valve allows the first main pressure chamber and the first sub-pressure chamber to communicate with each other by opening the communication path by being pressed by the booster piston when the piston rod reaches a booster start position before a forward stroke end. A coupling-member containing chamber is formed in the booster piston so as to surround the piston rod, and a coupling member is disposed in the coupling-member containing chamber so as to surround the piston rod. An engagement surface and an engagement groove are formed in the coupling-member containing chamber and an outer peripheral surface of the piston rod, and, when the booster piston moves forward by an action of a pressure fluid supplied to the first sub-pressure chamber through the communication path, the engagement surface and the engagement groove engage with the coupling member and thereby the booster piston and the piston rod are coupled to each other.

In the present invention, a pressing member is provided on the booster piston, and the pressing member serves as both of valve opening means that opens the check valve by pressing the check valve when the piston rod performs a forward stroke and release means that releases coupling of the booster piston and the piston rod by pressing the coupling member when the booster piston performs a backward stroke.

Preferably, the pressing member is displaceable relative to the booster piston in the direction along the axial line, maintains the check valve in an open state by protruding from the booster piston by being pressed by the coupling member when the booster piston moves forward and the piston rod and the booster piston are coupled to each other by the coupling member, and releases coupling of the booster piston and the piston rod by entering an inside of the booster piston and pushing the coupling member when the booster piston moves backward to a backward stroke end.

According to a preferred embodiment of the present invention, the piston rod includes, in order from a back end thereof connected to the main piston toward a front end thereof, a first collar portion having a largest diameter, a second collar portion having a smaller diameter than the first collar portion, and a rod body having a smaller diameter than the second collar portion; and a part of the communication path and the check valve are provided in the first collar portion, and the engagement groove is provided in the second collar portion.

In this case, preferably, a valve chest of the check valve is formed in a front end portion of the first collar portion so as to communicate with the communication path; an annular valve seat that surrounds the communication path, a poppet valve body that contacts or separates from the annular valve seat, and a valve spring that presses the poppet valve body against the annular valve seat are disposed in the valve chest; the poppet valve body includes a push rod that protrudes to an outside of the valve chest; and, when the push rod is pushed by the booster piston, the poppet valve body separates from the annular valve seat and the communication path opens so as to communicate with the first sub-pressure chamber.

In the present invention, a ring-shaped rod packing may be provided on an inner periphery of a center hole of the partition wall, the first collar portion of the piston rod may have an outside diameter that allows the first collar portion to gas-tightly fit into the rod packing and to slide, and the first collar portion may fit into the rod packing when the piston rod reaches the booster start position and thereby the first sub-pressure chamber may be shut off from the second main pressure chamber.

In the present invention, the coupling member may include a plurality of steel balls or may include an elastic ring whose diameter is variable.

Advantageous Effects of Invention

With the present invention, the communication path is provided in the main piston and the piston rod, the check valve is provided in an end portion of the communication path, and, when the piston rod reaches the booster start position before the forward stroke end, the check valve opens so that the first main pressure chamber and the first sub-pressure chamber communicate with each other through the communication path. Therefore, a dedicated port for supplying the pressure fluid to the first sub-pressure chamber is not necessary, and, as a result, the number of ports is smaller than that of an exiting fluid pressure cylinder with a booster mechanism, and improvement of safety and simplification of piping work can be achieved by reducing the number of pipes.

DESCRIPTION OF EMBODIMENTS

Figure 1:
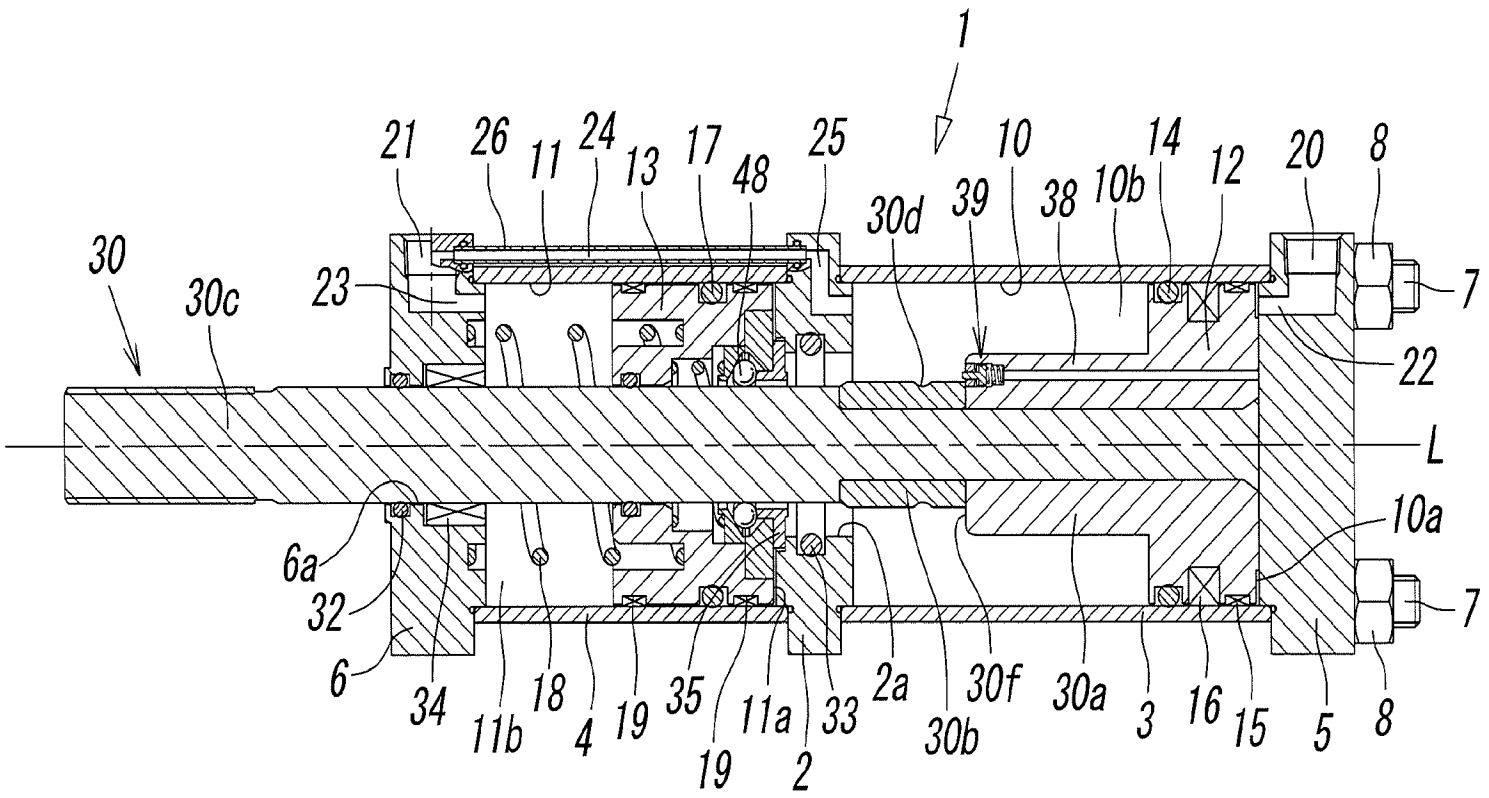
FIG. 1 is a sectional view of a fluid pressure cylinder with a booster mechanism according to the present invention, illustrating a state in which a piston and a piston rod occupy an initial position that is a backward stroke end.
Figure 2:
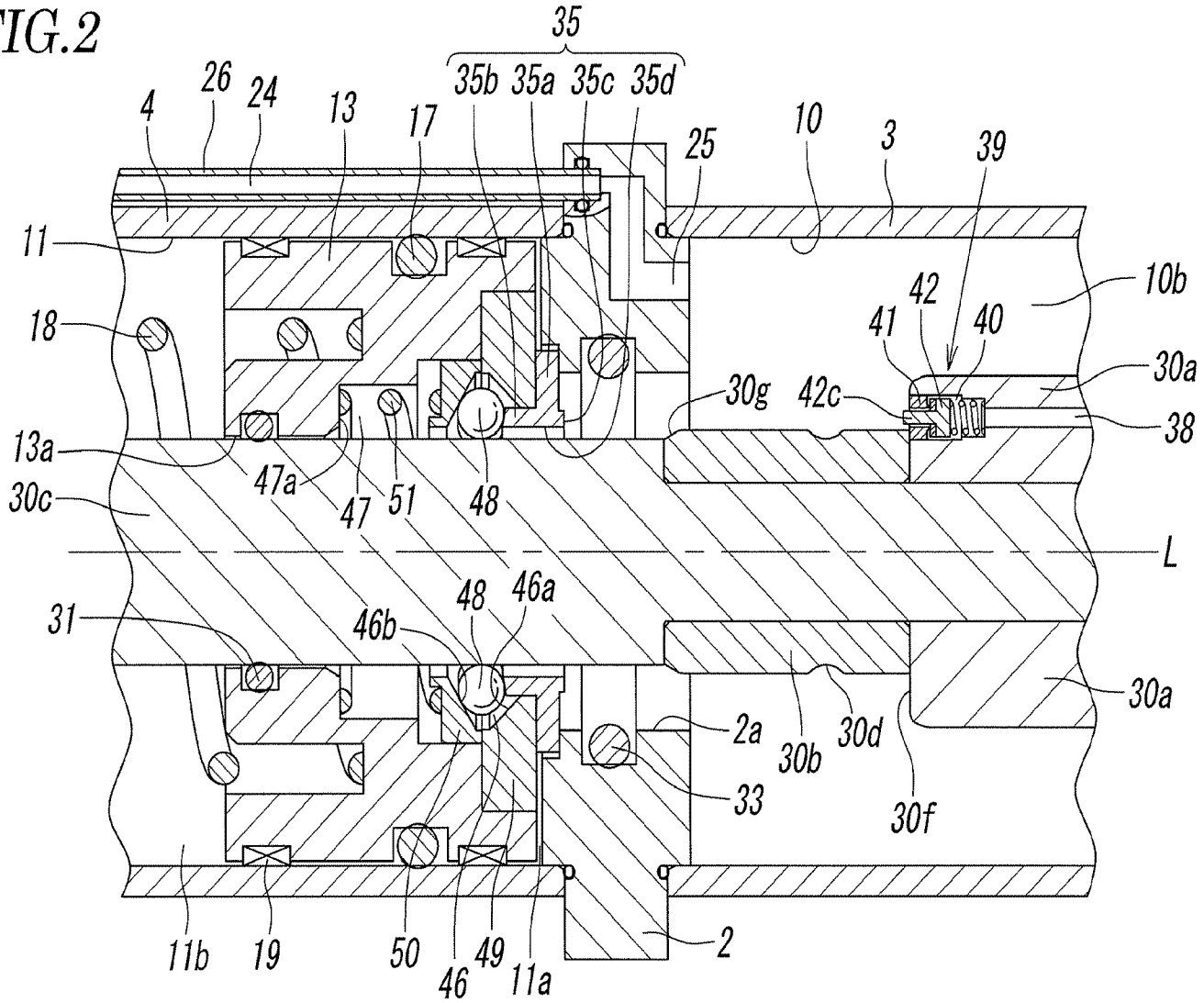
FIG. 2 is an enlarged view of a main part of FIG. 1.

FIGS. 1 to 8 illustrate a fluid pressure cylinder with a booster mechanism according to an embodiment of the present invention. The fluid pressure cylinder includes a cylinder body 1. The cylinder body 1 includes a partition wall 2 having a center hole 2*a*, a cylindrical first body 3 coupled to one side of the partition wall 2, a cylindrical second body 4 coupled to the other side of the partition wall 2, a first end wall 5 that blocks an open end of the first body 3, and a second end wall 6 that blocks an open end of the second body 4. The cylinder body 1 is assembled by tightening tie-rods 7, which extend between the first end wall 5 and the second end wall 6, by using nuts 8.

A main cylinder chamber 10 is formed in the first body 3, and a booster cylinder chamber 11 is formed in the second body 4. The main cylinder chamber 10 and the booster cylinder chamber 11 are separated by the partition wall 2 and located coaxially along an axial line L.

A main piston 12 is disposed in the main cylinder chamber 10 via a sealing member 14 so as to be slidable in a direction along the axial line L. The main cylinder chamber 10 is divided by the main piston 12 into a first main pressure chamber 10*a* between the main piston 12 and the first end wall 5 and a second main pressure chamber 10*b* between the main piston 12 and the partition wall 2.

The numeral 15 in the figure denotes a wear ring attached to an outer periphery of the main piston 12, and the numeral 16 in the figure denotes a position-detection magnet attached to the outer periphery of the main piston 12. By detecting magnetism of the magnet 16 by using a magnetic sensor (not shown), the movement position of the main piston 12 can be detected.

A booster piston 13 is disposed in the booster cylinder chamber 11 via a sealing member 17 so as to be slidable in the direction along the axial line L. The booster cylinder chamber 11 is divided by the booster piston 13 into a first sub-pressure chamber 11*a* between the partition wall 2 and the booster piston 13 and a second sub-pressure chamber 11*b* between the booster piston 13 and the second end wall 6. A return spring 18, which urges the booster piston 13 in a return direction, that is, in a direction toward the partition wall 2, is provided in the second sub-pressure chamber 11*b* between the booster piston 13 and the second end wall 6. The numeral 19 in the figure denotes a wear ring attached to an outer periphery of the booster piston 13.

A first port 20 is formed in the first end wall 5 of the cylinder body 1, and a second port 21 is formed in the second end wall 6. The first port 20 communicates with the first main pressure chamber 10*a* through a first communication hole 22 formed in the first end wall 5. The second port 21 communicates with the second sub-pressure chamber lib through a second communication hole 23 formed in the second end wall 6. The second port 21 also communicates with the second main pressure chamber 10*b* through a third communication hole 24 in a pipe 26 extending between the second end wall 6 and the partition wall 2 and a fourth communication hole 25 formed in the partition wall 2.

A back end portion of a piston rod 30, which has a cylindrical shape extending along the axial line L, is coupled to the main piston 12. The piston rod 30 is coupled to the main piston 12 by inserting a narrowed coupling portion 30*e* of the piston rod 30 into a coupling hole 12*a* at the center of the main piston 12 and by expanding an end portion of the coupling portion 30*e* and engaging the end portion with an end portion of the coupling hole 12*a*.

The piston rod 30 includes, in order from a back end thereof that is connected to the main piston 12 toward a front end thereof, a first collar portion 30*a* having the largest diameter, a second collar portion 30*b* having a smaller diameter than the first collar portion 30*a*, and a rod body 30*c* having a smaller diameter than the second collar portion 30*b*. The piston rod 30 sequentially extends through the center hole 2*a* of the partition wall 2, a center hole 13*a* of the booster piston 13, and a center hole 6*a* of the second end wall 6; and the front end of the piston rod 30 protrudes to the outside of the cylinder body 1. Among the center holes 2*a*, 13*a*, and 6*a*, the center hole 13*a* of the booster piston 13 and the center hole 6*a* of the second end wall 6 respectively have sizes that allow the rod body 30*c* of the piston rod 30 to gas-tightly slide via sealing members 31 and 32, and the center hole 2*a* of the partition wall 2 has a size that allows the first collar portion 30*a* to gas-tightly fit into the center hole 2*a* and to slide in the middle of a forward stroke of the piston rod 30. A rod packing 33 is attached to an inner periphery of the center hole.

The numeral 34 in the figure denotes a bearing attached to an inner periphery of the second end wall 6.

The first collar portion 30*a* is a cylindrical portion that is formed so as to be integrated with the main piston 12. The second collar portion 30*b* is a cylindrical member that is formed so as to be independent from the first collar portion 30*a* and the piston rod 30. However, the first collar portion 30*a* may be formed so as to be independent from the main piston 12.

Figure 5:
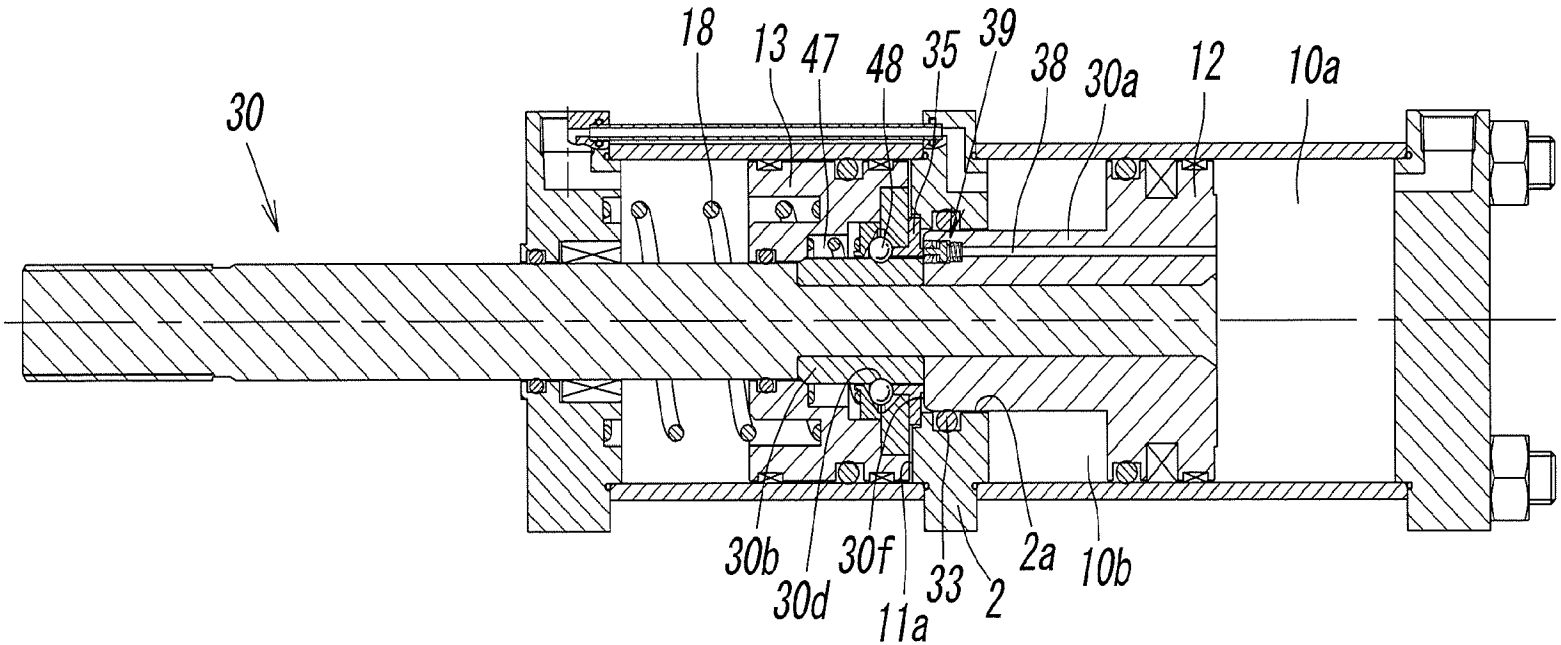
FIG. 5 illustrates a state in which the piston and the piston rod have moved forward to a booster start position.

The length of the first collar portion 30*a* in the direction along the axial line L is a length such that: when the main piston 12 and the piston rod 30 are at a backward stroke end shown in FIG. 1, a front end surface 30*f* of the first collar portion 30*a* is located in the second main pressure chamber 10*b*; and, when the main piston 12 and the piston rod 30 reach a booster start position before a forward stroke end as shown in FIG. 5, the first collar portion 30*a* fits into the rod packing 33 and the front end surface 30*f* of the first collar portion 30*a* is adjacent to or in contact with a pressing member 35 of the booster piston 13.

In the main piston 12 and the first collar portion 30*a* of the piston rod 30, a communication path 38, whose back end communicates with the first main pressure chamber 10*a*, is formed so as to be parallel to the axial line L. A front end of the communication path 38 reaches the front end surface 30*f* of the first collar portion 30*a*, and a check valve 39 is provided in a front end portion of the communication path 38.

Figure 3:
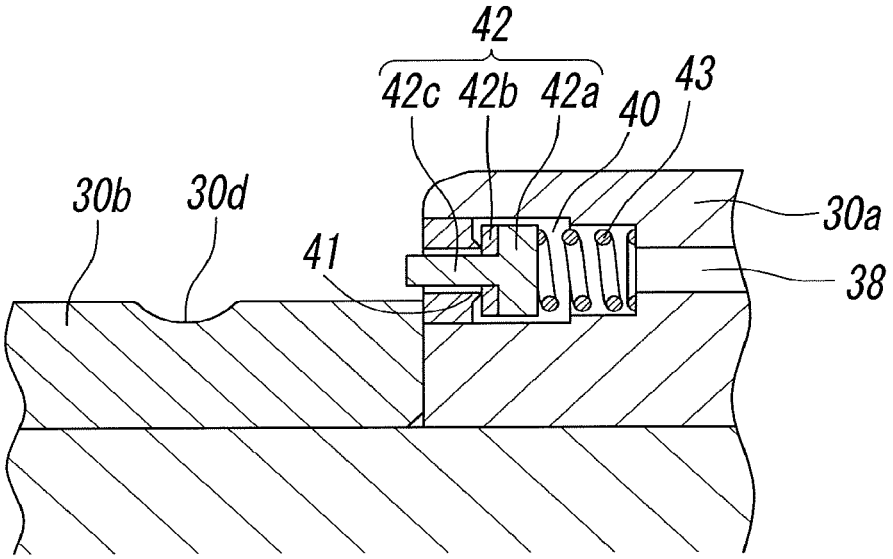
FIG. 3 is an enlarged view of another main part of FIG. 1.

As illustrated in FIG. 3, the check valve 39 includes a valve chest 40 that communicates with the communication path 38, an annular valve seat 41 formed at an open end of the valve chest 40 so as to surround the communication path 38, a poppet valve body 42 that opens or closes the communication path 38 by separating from or contacting the annular valve seat 41 in the valve chest 40, and a valve spring 43 that urges the poppet valve body 42 in a direction (valve closing direction) such that the poppet valve body 42 contacts the annular valve seat 41. The poppet valve body 42 includes a disk-shaped open/close portion 42*a*, to which a sealing member 42*b* is attached, and a push rod 42*c*, which extends from the open/close portion 42*a*. A front end of the push rod 42*c* extends through a center hole of the annular valve seat 41 and protrudes to the outside of the valve chest 40.

In the booster piston 13, a coupling-member containing chamber 46 and a space 47, into which the second collar portion 30*b* fits, are formed so as to surround the piston rod 30. In the coupling-member containing chamber 46, a plurality of steel balls 48 are arranged so as to surround the piston rod 30 and are contained so as to be freely movable. As described below in detail, when the booster piston 13 moves forward by the action of a pressure fluid, the plurality of steel balls 48 engage with both of the booster piston 13 and the piston rod 30 and function as a coupling member that couples the booster piston 13 and the piston rod 30 to each other.

The coupling-member containing chamber 46, which is a space having a cross-sectional shape that is surrounded by two sides of a triangle, has a first chamber wall 46*a* close to the partition wall 2 and a second chamber wall 46*b* away from the partition wall 2. The first chamber wall 46*a* serves as an engagement surface that the steel balls 48 engage when the booster piston 13 and the piston rod 30 are coupled to each other. The first chamber wall 46*a* has a conical surface that is inclined in a direction such that the surface becomes closer to the axial line L toward the partition wall 2. The second chamber wall 46*b* has a conical surface that is inclined in a direction opposite to the direction of the first chamber wall 46*a*. However, the first chamber wall 46*a* may be a curved surface that is convexly or concavely curved.

The first chamber wall 46*a* is formed by a ring-shaped coupling member retainer 49 that is fixed to the booster piston 13 with screws (not shown). The second chamber wall 46*b* is formed by a ring-shaped coupling member retainer 50 that is contained in the space 47 so as to be displaceable in the direction along the axial line L. The coupling member retainer 50 is continuously urged toward the coupling member retainer 49 by a compression spring 51 that is disposed between a step portion 47*a* of the space 47 and the coupling member retainer 50.

An engagement groove 30*d*, onto which the steel balls 48 move and with which the steel balls 48 engage when the piston rod 30 moves forward and the second collar fits into the space 47, is formed in an outer periphery of the second collar portion 30*b*. A front end surface 30*g* of the second collar portion 30*b* is inclined so that the steel balls 48 can easily move onto the second collar portion 30*b*.

Moreover, the pressing member 35, which is hollow, is disposed at an end portion of the booster piston 13 near the partition wall 2 so as to surround the piston rod 30. The pressing member 35 includes a flange portion 35*a* that is parallel to an end surface of the booster piston 13, a cylindrical first pressing portion 35*b* that protrudes from an inside-diameter portion of the flange portion 35*a* in a direction such that the first pressing portion 35*b* fits into the booster piston 13 and that has a front end that enters an inside of the coupling-member containing chamber 46, and a cylindrical second pressing portion 35*c* that protrudes from the flange portion 35*a* in a direction opposite to the direction of the first pressing portion 35*b*. The protruding length of the first pressing portion 35*b*, which is larger than the protruding length of the second pressing portion 35*c* in the example shown in the figure, may be equal to or smaller than the protruding length of the second pressing portion 35*c*. The pressing member 35 is displaceable between a position shown in FIG. 1, at which the flange portion 35*a* is in contact with the end surface of the booster piston 13, and a position shown in FIG. 7, at which the flange portion 35*a* is separated from the end surface of the booster piston 13. The pressing member 35 is a part of the booster piston 13.

Figure 6:
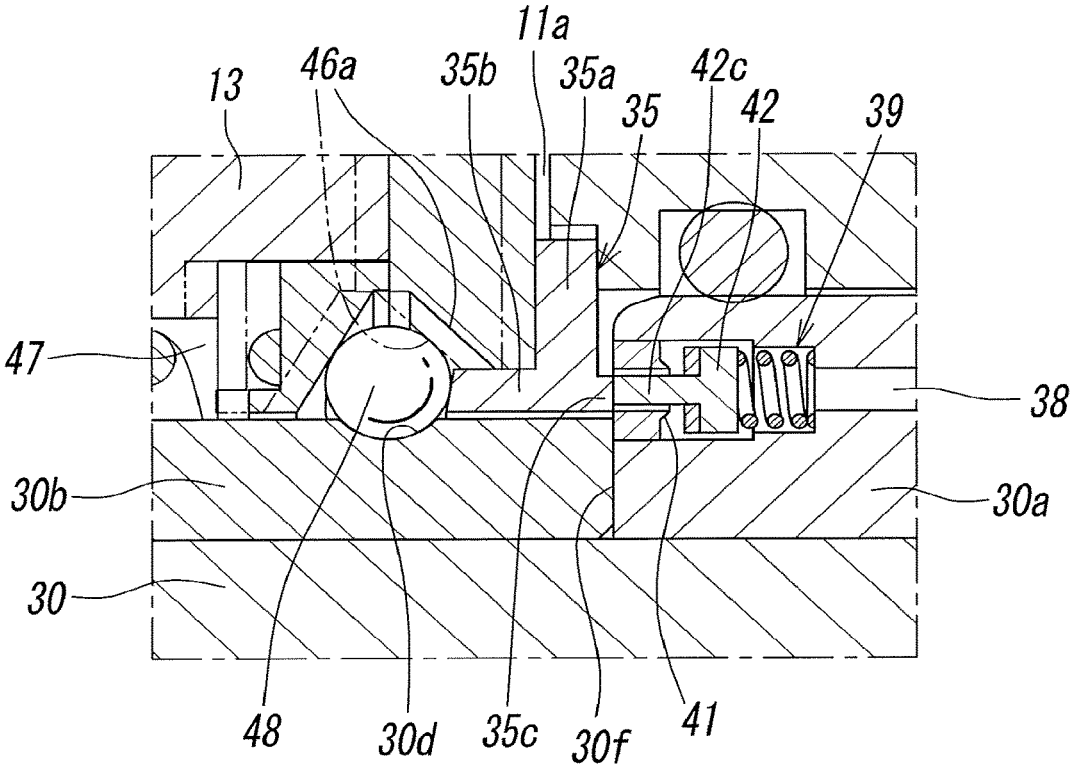
FIG. 6 is an enlarge view of a main part of FIG. 5.

As illustrated in FIG. 6, the dimensions and the disposition of the second pressing portion 35*c* of the pressing member 35 are such that the second pressing portion 35*c* does not completely block the communication path 38 even when the second pressing portion 35*c* pushes the push rod 42*c* of the poppet valve body 42 inward and contacts the front surface of the valve chest 40.

Next, the function of the fluid pressure cylinder with a booster mechanism will be described. Regarding the detailed structure of the fluid pressure cylinder, reference will be also made to FIGS. 2 and 3.

FIG. 1 illustrates a state in which the second port 21 is connected to the intake side and the first port 20 is connected to the exhaust side, and thereby a pressure fluid is supplied to the second main pressure chamber 10*b* and the second sub-pressure chamber 11*b* and a pressure fluid in the first main pressure chamber 10*a* is discharged. At this time, the main piston 12 and the piston rod 30 occupy an initial position, which is the backward stroke end, due to the fluid pressure in the second main pressure chamber 10*b;* and the booster piston 13 occupies a return position (initial position), at which the booster piston 13 is in contact with the partition wall 2 due to the urging force of the return spring 18. The second main pressure chamber 10*b* and the first sub-pressure chamber 11*a* communicate with each other through the center hole 2*a* of the partition wall 2.

Figure 4:
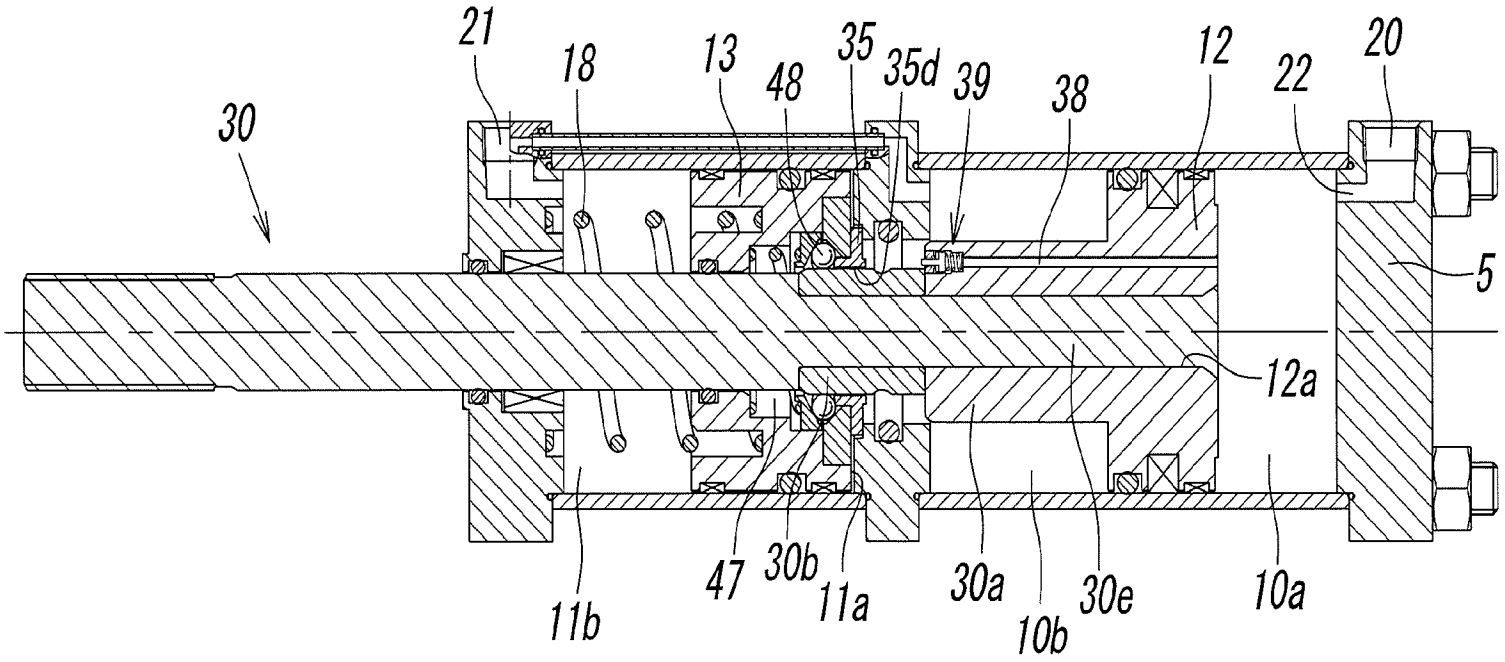
FIG. 4 illustrates a state in which the piston and the piston rod have moved to a middle position of a forward stroke from the initial position shown in FIG. 1.

From the state shown in FIG. 1, as illustrated in FIG. 4, when the first port 20 is connected to the intake side and the second port 21 is connected to the exhaust side, a pressure fluid is supplied to the first main pressure chamber 10*a* and the pressure fluid in the second main pressure chamber 10*b* and the second sub-pressure chamber 11*b* is discharged, and thereby the main piston 12 and the piston rod 30 start moving forward in the leftward direction in the figure. However, because the first sub-pressure chamber 11*a* is open to the outside through the second main pressure chamber 10*b* and is not influenced by the pressure fluid from the first port 20, the booster piston 13 is retained at the return position due to the urging force of the return spring 18 and does not move forward.

The position of the piston rod 30 shown in FIG. 4 is a position in the middle of a stroke in a state in which the front end of the second collar portion 30*b* enters the space 47 in the booster piston 13 through a center hole 35*d* of the pressing member 35 and thereby the steel balls 48 have moved onto the second collar portion 30*b*.

When the piston rod 30 moves further forward to a position just before the booster start position shown in FIG. 5, the front end portion of the first collar portion 30*a* fits into the rod packing 33 in the center hole 2*a* of the partition wall 2, thereby the first sub-pressure chamber 11*a* is shut off from the second main pressure chamber 10*b,* and, immediately thereafter, the piston rod 30 reaches the booster start position shown in FIG. 5.

When the piston rod 30 reaches the booster start position, as is clear also from FIG. 6, the second collar portion 30*b* completely enters the space 47 in the booster piston 13, the steel balls 48 fit into the engagement groove 30*d,* and the push rod 42*c* of the poppet valve body 42, which has been protruding from the front end surface 30*f* of the first collar portion 30*a,* contacts the second pressing portion 35*c* of the pressing member 35 of the booster piston 13 and is pushed by the pressing portion 35*c;* and thereby the poppet valve body 42 becomes separated from the annular valve seat 41 and opens the communication path 38. Thus, the pressure fluid in the first main pressure chamber 10*a* is started to be supplied to the first sub-pressure chamber 11*a* through the communication path 38, and therefore the booster piston 13 starts moving forward while compressing the return spring 18.

Then, as shown by a chain line in FIG. 6, when the booster piston 13 moves slightly forward and the first chamber wall 46*a* (engagement surface) of the coupling-member containing chamber 46 contacts the steel balls 48, the first chamber wall 46*a* strongly press the steel balls 48 against the engagement groove 30*d* along the inclination. Thus, the booster piston 13 and the piston rod 30 are coupled to each other via the steel balls 48, and the thrust of the booster piston 13 acts on the piston rod 30. Therefore, large combined thrust, which is the sum of the thrust of the main piston 12 and the thrust of the booster piston 13, acts on the piston rod 30, and the piston rod 30 is moved forward to the forward stroke end shown in FIG. 7.

When the first chamber wall 46*a* contacts the steel balls 48, the steel balls 48 become relatively displaced in the coupling-member containing chamber 46 in the direction of the first chamber wall 46*a*. Therefore, the first pressing portion 35*b* of the pressing member 35 is pushed outward by the steel balls 48 toward the outside of the coupling-member containing chamber 46. As a result, the pressing member 35 becomes displaced to a position such that the flange portion 35*a* is separated from the end surface of the booster piston 13.

Figure 7:
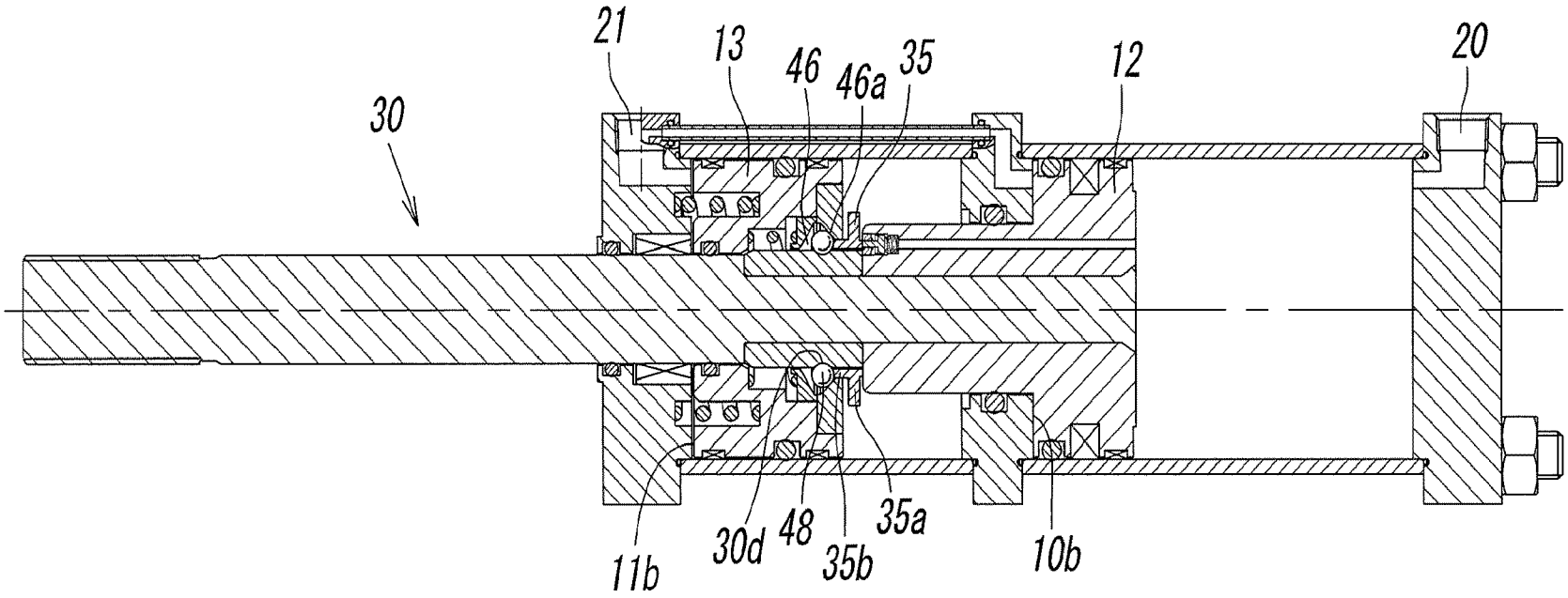
FIG. 7 illustrates a state in which the piston and the piston rod have reached a forward stroke end.

Next, when moving the main piston 12 and the piston rod 30 backward from the state shown in FIG. 7, the first port 20 is connected to the exhaust side, and the second port 21 is connected to the intake side. Then, both of the main piston 12 and the booster piston 13 move backward due to a pressure fluid supplied to the second main pressure chamber 10*b* and a pressure fluid supplied to the second sub-pressure chamber 11*b*.

Figure 8:
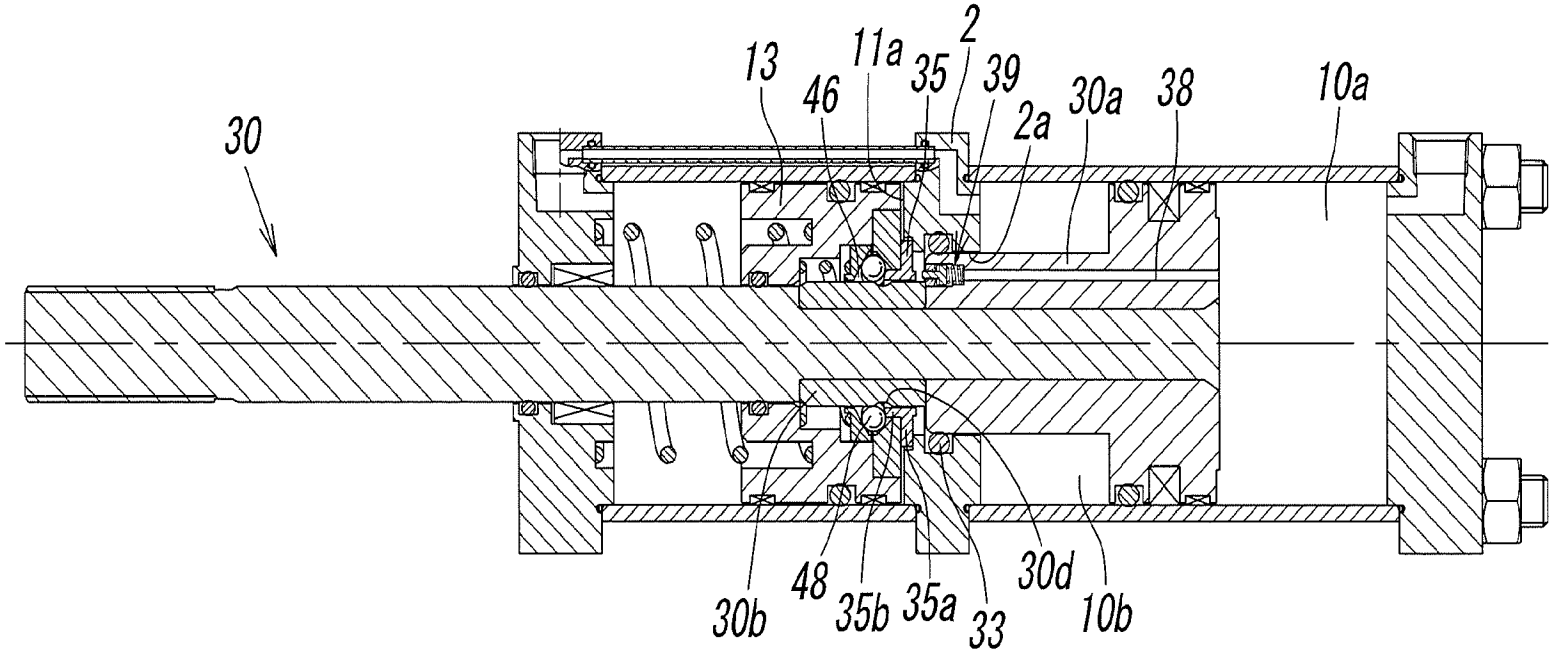
FIG. 8 illustrates a state in which the piston and the piston rod have moved to a middle position of a backward stroke and a booster piston has returned to an initial position.

Then, as illustrated in FIG. 8, when the booster piston 13 reaches the return position, which is the backward stroke end, the flange portion 35*a* of the pressing member 35 contacts the partition wall 2, and thereby the pressing member 35 stops at the position and the booster piston 13 also stops at the position by contacting the pressing member 35 with a slight delay. However, because the piston rod 30 continues to move backward, the steel balls 48 are pressed by the first pressing portion 35*b* of the pressing member 35 and move out from the engagement groove 30*d,* and coupling of the booster piston 13 and the piston rod 30 is released. At the same time, pressing of the push rod 42*c* by the second pressing portion 35*c* of the pressing member 35 is also released. Thus, the poppet valve body 42 contacts the annular valve seat 41 due to the urging force of the valve spring 43 and blocks the communication path 38, and the check valve 39 is closed. Therefore, communication between the first main pressure chamber 10*a* and the first sub-pressure chamber 11*a* through the communication path 38 is blocked.

Subsequently, when the main piston 12 and the piston rod 30 move further backward, the first collar portion 30*a* is pulled out from the rod packing 33 in the partition wall 2, and thereby the second main pressure chamber 10*b* and the first sub-pressure chamber 11*a* communicate with each other through the center hole 2*a* of the partition wall 2. In this state, the main piston 12 and the piston rod 30 move to the backward stroke end (initial position) shown in FIG. 1.

At this time, a pressure fluid flows into the first sub-pressure chamber 11*a* from the second main pressure chamber 10*b*, and the booster piston 13 receives a force acting in the leftward direction in the figure, that is, in the forward direction by the pressure fluid. However, because the booster piston 13 receives a force acting in the rightward direction in the figure by a pressure fluid supplied to the second sub-pressure chamber lib, the forces acting in both directions cancel out, and the booster piston 13 maintains the initial position due to the urging force of the return spring 18.

Figure 9:
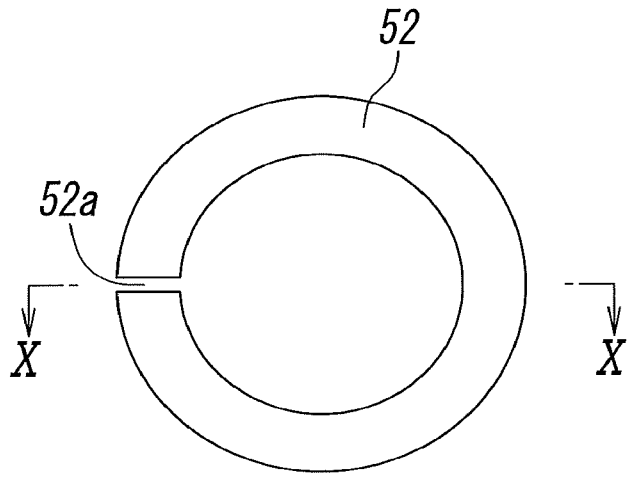
FIG. 9 is a front view of another example of a coupling member.
Figure 10:
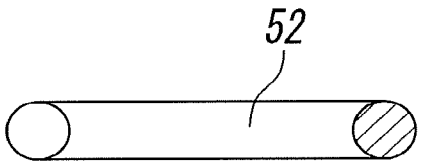
FIG. 10 is a sectional view taken along line X-X of FIG. 9.

FIGS. 9 and 10 illustrate a coupling member that can be used instead of the steel balls 48 to couple the booster piston 13 and the piston rod 30 to each other. The coupling member is formed by an elastic ring 52 whose diameter is variable by providing a cut 52*a* in a part thereof. The cross-sectional shape of the elastic ring 52 is circular. The inside diameter of the elastic ring 52, which is slightly larger than the outside diameter of the rod body 30*c* of the piston rod 30, is preferably smaller than the outside diameter of the second collar portion 30*b*.

As described above in detail, in the fluid pressure cylinder with a booster mechanism according to the present invention, the communication path 38 is provided in the main piston 12 and the piston rod 30, the check valve 39 is provided in an end portion of the communication path 38, and, when the piston rod 30 reaches the booster start position before the forward stroke end, the check valve 39 opens so that the first main pressure chamber 10*a* and the first sub-pressure chamber 11*a* communicate with each other through the communication path 38. Therefore, a dedicated port for supplying the pressure fluid to the first sub-pressure chamber 11*a* is not necessary, and, as a result, the number of ports is smaller than that of an exiting fluid pressure cylinder with a booster mechanism, and improvement of safety and simplification of piping work can be achieved by reducing the number of pipes.

REFERENCE SIGNS LIST

1 cylinder body
2 partition wall
6 second end wall
6*a* center hole
10 main cylinder chamber
10*a* first main pressure chamber
10*b* second main pressure chamber
11 booster cylinder chamber
11*a* first sub-pressure chamber
11*b* second sub-pressure chamber
12 main piston
13 booster piston
20 first port
21 second port
30 piston rod
30*a* first collar portion
30*b* second collar portion
30*c* rod body
30*d* engagement groove
30*f* front end surface of first collar portion
33 rod packing
35 pressing member
38 communication path
39 check valve
40 valve chest
41 annular valve seat
42 poppet valve body
43 valve spring
46 coupling-member containing chamber
48 steel ball (coupling member)
52 elastic ring (coupling member)
L axial line

The invention claimed is:

1. A fluid pressure cylinder with a booster mechanism, wherein a main cylinder chamber and a booster cylinder chamber that are separated by a partition wall are provided in a cylinder body, wherein a main piston is disposed in the main cylinder chamber so as to be slidable in a direction along an axial line, and the main cylinder chamber is divided by the main piston into a first main pressure chamber and a second main pressure chamber, wherein a booster piston is disposed in the booster cylinder chamber so as to be slidable in the direction along the axial line, and the booster cylinder chamber is divided by the booster piston into a first sub-pressure chamber and a second sub-pressure chamber, wherein a first port that communicates with the first main pressure chamber and a second port that communicates with the second main pressure chamber and the second sub-pressure chamber are provided in the cylinder body, wherein a piston rod is coupled to the main piston, and the piston rod extends to an outside through the partition wall, the booster piston, and an end wall of the booster cylinder chamber, wherein a communication path, one end of which communicates with the first main pressure chamber and at the other end of which a check valve is disposed, is provided in the main piston and the piston rod, and the check valve allows the first main pressure chamber and the first sub-pressure chamber to communicate with each other by opening the communication path by being pressed by the booster piston when the piston rod reaches a booster start position before a forward stroke end, wherein a coupling-member containing chamber is formed in the booster piston so as to surround the piston rod, and a coupling member is disposed in the coupling-member containing chamber so as to surround the piston rod, and wherein an engagement surface and an engagement groove are formed in the coupling-member containing chamber and an outer peripheral surface of the piston rod, and, when the booster piston moves forward by an action of a pressure fluid supplied to the first sub-pressure chamber through the communication path, the engagement surface and the engagement groove engage with the coupling member and thereby the booster piston and the piston rod are coupled to each other.

2. The fluid pressure cylinder according to claim 1, wherein a pressing member is provided on the booster piston, and the pressing member serves as both of valve opening means that opens the check valve by pressing the check valve when the piston rod performs a forward stroke and release means that releases coupling of the booster piston and the piston rod by pressing the coupling member when the booster piston performs a backward stroke.

3. The fluid pressure cylinder according to claim 2, wherein the pressing member is displaceable relative to the booster piston in the direction along the axial line, maintains the check valve in an open state by protruding from the booster piston by being pressed by the coupling member when the booster piston moves forward and the piston rod and the booster piston are coupled to each other by the coupling member, and releases coupling of the booster piston and the piston rod by entering an inside of the booster piston and pushing the coupling member when the booster piston moves backward to a backward stroke end.

4. The fluid pressure cylinder according to claim 1, wherein the piston rod includes, in order from a back end thereof connected to the main piston toward a front end thereof, a first collar portion having a largest diameter, a second collar portion having a smaller diameter than the first collar portion, and a rod body having a smaller diameter than the second collar portion; and a part of the communication path and the check valve are provided in the first collar portion, and the engagement groove is provided in the second collar portion.

5. The fluid pressure cylinder according to claim 4, wherein a valve chest of the check valve is formed in a front end portion of the first collar portion so as to communicate with the communication path; an annular valve seat that surrounds the communication path, a poppet valve body that contacts or separates from the annular valve seat, and a valve spring that presses the poppet valve body against the annular valve seat are disposed in the valve chest; the poppet valve body includes a push rod that protrudes to an outside of the valve chest; and, when the push rod is pushed by the booster piston, the poppet valve body separates from the annular valve seat and the communication path opens so as to communicate with the first sub-pressure chamber.

6. The fluid pressure cylinder according to claim 4, wherein a ring-shaped rod packing is provided on an inner periphery of a center hole of the partition wall, the first collar portion of the piston rod has an outside diameter that allows the first collar portion to gas-tightly fit into the rod packing and to slide, and the first collar portion fits into the rod packing when the piston rod reaches the booster start position and thereby the first sub-pressure chamber is shut off from the second main pressure chamber.

7. The fluid pressure cylinder according to claim 1, wherein the coupling member includes a plurality of steel balls.

8. The fluid pressure cylinder according to claim 1, wherein the coupling member includes an elastic ring whose diameter is variable.

* * * * *